US007914357B2

(12) United States Patent
Koyanagi et al.

(10) Patent No.: US 7,914,357 B2
(45) Date of Patent: Mar. 29, 2011

(54) AIRTIGHT CONTAINER AND MANUFACTURING METHOD OF IMAGE DISPLAYING APPARATUS USING AIRTIGHT CONTAINER

(75) Inventors: Kazuo Koyanagi, Atsugi (JP); Mitsutoshi Hasegawa, Yokohama (JP); Nobuhiro Ito, Yamato (JP); Akihiro Kimura, Yokohama (JP); Masahiro Tagawa, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 372 days.

(21) Appl. No.: 12/178,230

(22) Filed: Jul. 23, 2008

(65) Prior Publication Data

US 2009/0029622 A1 Jan. 29, 2009

(30) Foreign Application Priority Data

Jul. 26, 2007 (JP) ..... 2007-194615
Jun. 25, 2008 (JP) ..... 2008-165697

(51) Int. Cl.
*H01J 9/26* (2006.01)

(52) U.S. Cl. ..... 445/25; 445/24

(58) Field of Classification Search ..... 445/24–25
See application file for complete search history.

(56) References Cited

U.S. PATENT DOCUMENTS 4,135,789 A * 1/1979 Hall ..... 349/154
4,582,210 A * 4/1986 Morimoto et al. ..... 220/2.2
4,770,310 A * 9/1988 Morimoto et al. ..... 220/2.2
6,261,145 B1 7/2001 Lee et al. ..... 445/25
6,459,198 B1 * 10/2002 Dean et al. ..... 313/493

FOREIGN PATENT DOCUMENTS

JP 2003-192399 7/2003

* cited by examiner

*Primary Examiner* — Anne M Hines
(74) *Attorney, Agent, or Firm* — Fitzpatrick, Cella, Harper & Scinto

(57) ABSTRACT

A manufacturing method of an image displaying apparatus, having an airtight container with a vacuum interior, includes the steps of exhausting an inside of a container via a through-hole provided in the container, arranging a plate member on an outer surface of the container, the inside of which was exhausted, so as to close the through-hole, and sealing the container by arranging a cover member to cover the plate member and by bonding the arranged cover member and the outer surface of the container to each other via a sealant positioned between the cover member and the outer surface of the container. The sealing includes hardening the sealant after deforming the sealant by pressing the plate member, and the plate member has a terminal portion including a conductive material. Additional steps include providing an anode electrode in the airtight container, and performing the sealing in a state that the terminal portion is in contact with the anode electrode.

1 Claim, 7 Drawing Sheets

AIRTIGHT CONTAINER AND MANUFACTURING METHOD OF IMAGE DISPLAYING APPARATUS USING AIRTIGHT CONTAINER

BACKGROUND OF THE INVENTION

1. Field of the Invention

The present invention relates to a manufacturing method of an airtight container. In particular, the present invention relates to a manufacturing method of a vacuum airtight container (envelope) used for a flat panel image displaying apparatus.

2. Description of the Related Art

An image displaying apparatus, in which a number of electron-emitting devices for emitting electrons according to image signals are provided on a rear plate and a fluorescent film for displaying an image by emitting light in response to irradiation of electrons is provided on a face plate, and of which the inside is maintained with vacuum, has been known. In the image displaying apparatus like this, generally, the face plate and the rear plate are bonded to each other through a support frame, thereby forming an envelope. In case of manufacturing the image displaying apparatus like this, it is necessary to exhaust the inside of the envelope to secure a vacuum. Such an exhausting process can be achieved by several kinds of methods. As one of these methods, a method of exhausting the inside of a container through a through-hole provided on the surface of the container and thereafter sealing the through-hole has been known.

In case of sealing the through-hole by a cover member, it is necessary to arrange a sealant around the through-hole to obtain a sealing effect. Here, several kinds of methods of arranging the sealant have been known. When one of these methods is applied to a vacuum airtight container, it is desirable to select the method which can prevent the sealant from flowing into the through-hole. This is because, although it is necessary to heat and then soften or melt the sealant to uniformly arrange and form it around the through-hole, there is a fear at this time that the sealant flows into the through-hole due to a difference between internal and external pressures of the container. In particular, in case of manufacturing the envelope of the image displaying apparatus, the sealant which has flowed inside the through-hole accounts for an electrical discharge phenomenon.

Here, Japanese Patent Application Laid-Open No. 2003-192399 (called a patent document 1 hereinafter) discloses a technique for tapering the face opposite to the through-hole of a cover member. More specifically, in the patent document 1, the distance between the tapered face and the face on which the through-hole has been formed becomes wider as the tapered face goes apart from the periphery of the through-hole. Then, the melted sealant is deformed due to the weight of the sealant itself, the deformed sealant moves toward the tapered portion, thereby restraining the sealant from flowing into the through-hole.

U.S. Pat. No. 6,261,145 (called a patent document 2 hereinafter) discloses a technique for closing a circular through-hole by a spherical metal cap or the like, externally filling up a sealant to the contact portion between the through-hole and the cap, and thus sealing the through-hole. More specifically, in the patent document 2, since the cap is fit into the tapered through-hole, the force toward the inside of a container is applied to the cap if the inside of the cap is vacuum. Thus, the cap is in tight contact with the through-hole, and it becomes difficult for the sealant to flow in the through-hole.

In the patent document 1, since the sealant directly faces the through-hole, there is a strong possibility that the sealant flows into the through-hole when it is melted. More specifically, although most sealant flows into the tapered portion, there is a possibility that a part of the sealant flows inside the through-hole due to the vacuum inside the container. In the patent document 2, the sealant is applied merely to the vicinity of the cap. That is, unlike the patent document 1, the patent document 2 does not include any process of pressing the sealant. For this reason, since it is difficult in the patent document 2 to uniformly distribute the sealant, there is a possibility that it is difficult to obtain sufficient sealing performance.

SUMMARY OF THE INVENTION

The present invention aims, in a manufacturing method of an airtight container including a process of sealing a through-hole by a cover member, to provide the manufacturing method which can secure sealing performance and also restrain a sealant from flowing into the through-hole. Moreover, the present invention aims to provide a manufacturing method of an image displaying apparatus, which uses the relevant manufacturing method of the airtight container.

An airtight container manufacturing method according to the present invention, comprises: (a) a step of exhausting the inside of a container via a through-hole provided on the container; (b) a step of arranging a plate member on the outer surface of the container the inside of which was exhausted, so as to close up the through-hole; and (c) a step of sealing the container by arranging a cover member so as to cover the plate member and by bonding the arranged cover member and the outer surface of the container to each other via a sealant positioned between the cover member and the outer surface of the container. Further, the step of sealing the container includes hardening the sealant after deforming the sealant as pressing the plate member.

Another airtight container manufacturing method according to the present invention, comprises: (a) a step of exhausting the inside of a container via a through-hole provided on the container; (b) a step of arranging a laminated body on which a plate member and a cover member have been laminated with a sealant interposed between the plate member and the cover member; and (c) a step of sealing the container by pressing the laminated body toward the outer surface of the container the inside of which was exhausted, so as to close up the through-hole by the plate member, and by bonding the cover member and the outer surface of the container to each other via the sealant. Further, the step of sealing the container includes hardening the sealant after deforming the sealant as pressing the plate member by the cover member.

The manufacturing method of the image displaying apparatus, according to the present invention, comprising an airtight container the inside of which has been vacuumized, comprising: exhausting the inside of a container via a through-hole provided on the container; arranging a plate member on the outer surface of the container the inside of which was exhausted, so as to close up the through-hole; and sealing the container by arranging a cover member so as to cover the plate member and by bonding the arranged cover member and the outer surface of the container to each other via a sealant positioned between the cover member and the outer surface of the container, wherein the sealing includes hardening the sealant after deforming the sealant as pressing the plate member.

According to the present invention, in the manufacturing method of the airtight container including the process of sealing the through-hole by the cover member, it is possible to provide the manufacturing method which can secure the sealing performance and also restrain the sealant from flowing into the through-hole. Moreover, according to the present invention, it is possible to provide the manufacturing method of the image displaying apparatus, which uses the relevant manufacturing method of the airtight container.

Further features of the present invention will become apparent from the following description of exemplary embodiments with reference to the attached drawings.

DESCRIPTION OF THE EMBODIMENTS

A manufacturing method of an airtight container of the present invention can be widely applied to a manufacturing method of an airtight container of which the inside is exhausted to be vacuumized. Particularly, the present invention can be preferably applied to a manufacturing method of an envelope of a flat panel image displaying apparatus of which the inside is exhausted to be vacuumized.

First Embodiment

The first embodiment of the present invention will be described with reference to FIGS. 1A to 1F. FIGS. 1A to 1F are schematic step views indicating a sealing process, which can be particularly preferably used in a case that a through-hole is sealed under a state that the through-hole of an airtight container is placed on an upper surface of an envelope.

(Step S1)

Figure 1A:
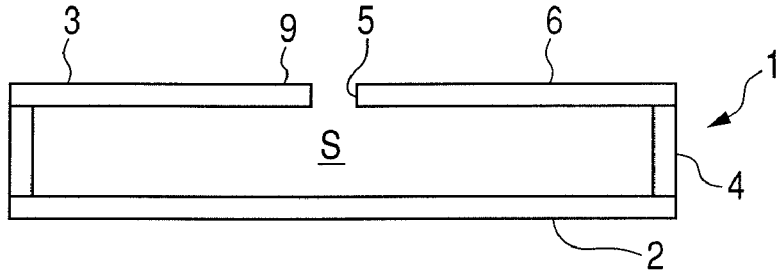
FIGS. 1A, 1B, 1C, 1D, 1E and 1F are schematic step views indicating a sealing process of the first embodiment.

Initially, an inside S of a container 1 is exhausted via a through-hole 5 provided on a surface of the container 1. The container 1 can have the desired materials and constitution. In case of a flat panel image displaying apparatus, a part of the container 1 is usually manufactured by the glass. In the present embodiment, as indicated in FIG. 1A, the container 1 is composed of a face plate 2, a rear plate 3 and a support frame 4, which are mutually bonded by a proper means such as a glass frit, to form an airtight container. A large number of electron emitters (not illustrated) for emitting electrons in accordance with an image signal are provided on the rear plate 3. A fluorescent film (not illustrated), which emits the light upon receiving the irradiation of electrons and display images, is provided on the face plate 2. Additionally, the through-hole 5, which is an aperture nearly equal to a circular form, is provided on the rear plate 3. The position and size of the through-hole 5 are properly set considering a desired degree of vacuum in the container 1 and a desired exhausting time. In the present embodiment, only the one through-hole 5 is provided, however plural holes may be provided. In order to improve adherence and wettability with a sealant 12 described later, a surface treatment may be performed to a circumference portion of the through-hole 5 on an outer surface 6 of the container 1 by use of an ultrasonic cleaning process or a metal film may be deposited.

An exhaust unit of the container 1 is selected such that the inside of the container 1 becomes a desired degree of vacuum. The exhaust unit is not especially limited if the inside of the container 1 is exhausted via the through-hole 5 and a process to be described later can be executed. If an exhausting process is executed under a condition that the whole container 1 is set inside a vacuum-exhaust chamber, since the moving mechanisms (rotating/vertical moving mechanisms 20 and 23) of respective members (a plate member 8 and a cover member 13) to be described later can be also provided in the same chamber, this situation is preferable.

(Step S2)

Figure 1B:
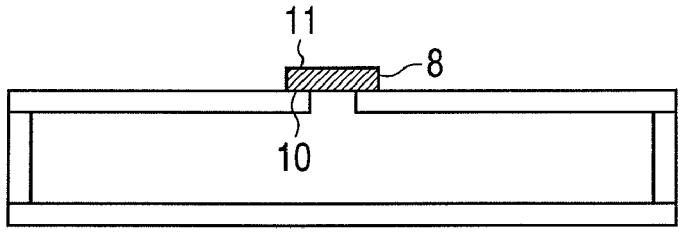

As indicated in FIG. 1B, the plate member 8 is arranged on the outer surface 6 of the container 1, of which the inside S was exhausted, so as to close up the through-hole 5. Specifically, the plate member 8 is arranged such that the plate member 8 contacts with a peripheral area 9 (refer to FIG. 1A) of the through-hole 5 along this area and the through-hole 5 is closed by the plate member 8. The plate member 8 which has such a size larger than that of the through-hole 5 is a circular member of which diameter is larger than that of the through-hole 5, in the present embodiment. It is preferable that the plate member 8 and the through-hole 5 are almost concentrically arranged. A contact surface 10 of the plate member 8 contacts with the outer surface 6 of the container 1 and prevents that the sealant 12 flows into the through-hole 5. Therefore, it is preferable that the configuration and surface roughness of the contact surface 10 is defined such that a gap (leak path) between the plate member 8 and the outer surface 6 of the container 1 becomes tight when the plate member 8 is arranged to cover the through-hole 5 of the container 1. The thickness of the plate member 8 is properly defined considering the sealing performance and the deformation characteristic of the sealant 12. In the present embodiment, a plate member having the projection structure (a projection portion 18) as described later in the second embodiment can be also used.

(Step S3)

Figure 1C:
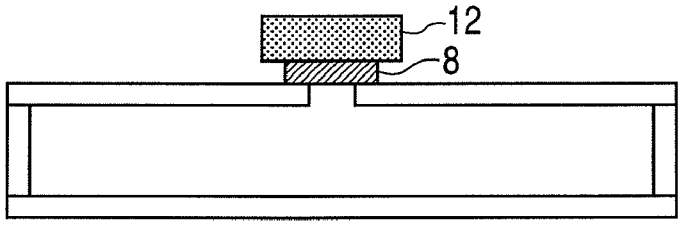

As indicated in FIG. 1C, the sealant 12 is provided on a surface 11 (refer to FIG. 1B) which is an opposite side to the contact surface 10 contacted with the through-hole 5 covered by the plate member 8. The sufficient amount of the sealant 12 is provided such that the sealant 12 covers the plate member 8 protruding to the outside of the plate member 8 and the sealant 12 becomes thicker than the plate member 8. The materials of the sealant 12 are not especially limited if the materials can obtain the desired sealing performance and adhesive characteristic. In the present embodiment, since the glass container 1 to be used in the flat panel image displaying apparatus is targeted, a glass frit or an indium alloy such as an In or an InSn is used considering the high sealing performance as the sealant 12 or the stress in heating.

(Step S4)

Figure 1D:
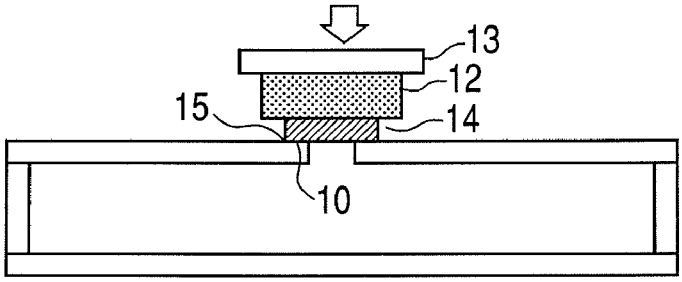
Figure 1E:
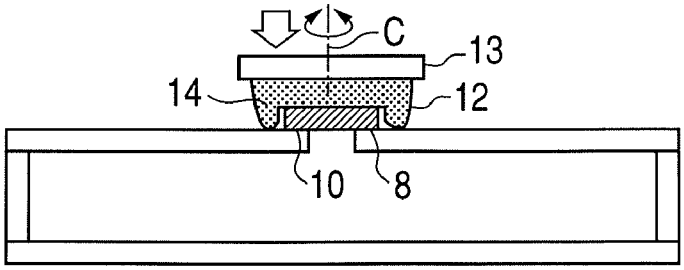
Figure 1F:
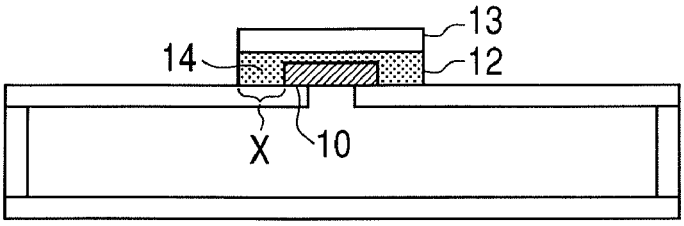

As indicated in FIG. 1D, the cover member 13 is arranged on the sealant 12. As a result of this arrangement, the cover member 13 is arranged so as to cover the plate member 8. It is desirable to use the cover member 13 having a plane area larger than that of the plate member 8 such that the sufficient sealing width X (refer to FIG. 1F) can be obtained on a circumference of the plate member 8 in response to the sealing characteristic of the sealant 12. Next, as indicated in FIGS. 1E and 1F, the sealant 12 is pressed in the vertical downward direction (direction indicated by an outline arrow) by the cover member 13 and the sealant 12 is deformed such that the sealant 12 fills up a space 14 between the cover member 13 and the outer surface 6 of the container 1 along an outer circumference portion 15 of the contact surface 10. Concretely, when the sealant 12 is pressed by the cover member 13, a part of the sealant 12 shifts to the lateral direction of the plate member 8 while deforming as indicated in FIG. 1E. And, another part of the sealant 12 also extends to the lateral direction along the cover member 13. When the sealant 12 is further pressed by the cover member 13, the sealant 12 completely fills up the space 14 as indicated in FIG. 1F and a width of the sealant 12 is extended to such a width nearly equal to that of the cover member 13. After that, the sealant 12 is heated to be hardened.

However, the sealant 12 is not always required to be deformed to become such the condition. For example, if a predetermined seal width X is ensured, it is not required to be extended to the same width as that of the cover member 13. In FIG. 1F, although the sealant 12 remains between the plate member 8 and the cover member 13, all the sealant 12 may be moved to the space 14 between the cover member 13 and the outer surface 6 of the container 1.

In case of pressing the sealant 12 by the cover member 13, it is desirable to heat the sealant 12 to the temperature of melting the sealant 12 in accordance with the characteristic of the sealant 12. Herewith, the deformation performance of the sealant 12 is improved. In the present embodiment, since the whole container 1 is set in the vacuum-exhaust chamber, a convective flow in heating can not be expected, and it is also considered that the heating efficiency is deteriorated. Therefore, as an object of shortening the heating time in case of heating the sealant 12 to the melting temperature, at least one of the plate member 8 and the cover member 13 may be heated within a range that the sealant 12 is not melted before a process of deforming the sealant 12. The heat from the plate member 8 or the cover member 13 is transmitted to the sealant 12, and a heating effect for the sealant 12 can be obtained. It is desirable that the heating temperature is set such that the plate member 8 or the cover member 13 is not destroyed by the sudden change of temperature.

A method of applying the load (press force) can be properly selected. For example, such a means of using a spring, mechanically applying the press force or arranging a weight can be enumerated. In the present embodiment, although the applying of load to keep a position of the cover member 13 and the applying of load to deform the sealant 12 are realized by the same load, different means may be used. As to the load in this case, a force of sufficiently squashing the sealant is required such that the sealant keeps at least the airtightness. When the sealant 12 is deformed, the sealant 12 may be pressed by the cover member 13 while rotating the cover member 13 around an axis by treating the axis parallel to the direction of pressing the sealant 12 (for example, a central axis C of the cover member 13) as a center of rotation as indicated in FIG. 1E. The sealant 12 is more effectively deformed and uniformly filled in the space 14.

According to the present embodiment, the sealant 12 is deformed while pressing the plate member 8 by the cover member 13, then the sealant 12 is hardened and a seal-bonding process is completed. That is, when the sealant 12 is melted and deformed, the plate member 8 closes up the through-hole 5 while being pressed to the through-hole 5 by the downward force. Therefore, the sealing performance between the contact surface 10 of the plate member 8 and the outer surface 6 of the container 1 is enhanced, and the melted sealant 12 becomes hard to flow into the through-hole 5. Accordingly, in the flat panel image displaying apparatus, when the high voltage to be used to display an image is applied, a discharge phenomenon caused by the sealant 12, which was flown in, can be easily prevented. In addition, according to the material of the sealant 12, although there is a case that the sealant 12 generates the gas, in the present embodiment, since the sealant 12 seldom flows inside the container 1, the negative influence to an electron emitter or the like due to the gas hardly occurs.

In the present embodiment, since effects by both the sealing between the contact surface 10 of the plate member 8 and the outer surface 6 of the container 1 and the sealing by the sealant 12 provided between the outer surface 6 of the container and the cover member 13 can be expected, the sealing performance itself is improved and the defective airtightness can be easily prevented.

In the present embodiment, the thickness of the plate member 8 results to define a minimum value of the thickness of the sealant 12. Therefore, even if the pressing load is large in some degree, deformation of the sealant 12 is prevented to be fixed to such a level less than the thickness of the plate member 8, and this fact leads to an improvement of reliability of the airtightness. However, in order to prevent to destroy the container 1, the plate member 8 and the cover member 13, it is not desirable to increase the pressing load particularly.

In the above embodiment, the sealant 12 was arranged on the back-surface 11 of the plate member 8. However, a sealing process may be performed by applying the sealant 12 to the side of the plate member 8 little thicker while pressing (squashing) the sealant 12 and the plate member 8 by the cover member 13. That is, if the cover member 13 and the outer surface 6 of the container 1 are finally sealed and bonded via the sealant 12 positioned between the cover member 13 and the outer surface 6 of the container 1, a position of initially providing the sealant 12 can be properly fixed.

Second Embodiment

The present embodiment is different from the first embodiment in a point that the through-hole is sealed by contacting a laminated body composed of the plate member, the sealant and the cover member with the through-hole from the downside of the through-hole, and other points are same as those in the first embodiment. Therefore, in the following description, a point different from that in the first embodiment will be mainly described, and as to matters not be described, refer to the description in the first embodiment.

The second embodiment of the present invention will be described with reference to FIGS. 2A to 2E. FIGS. 2A to 2E are schematic step views indicating a sealing process which can be especially preferably used in a case that the through-hole is sealed with a state that the through-hole of the airtight container was opened to the vertical downward direction.

(Step S51)

Figure 2A:
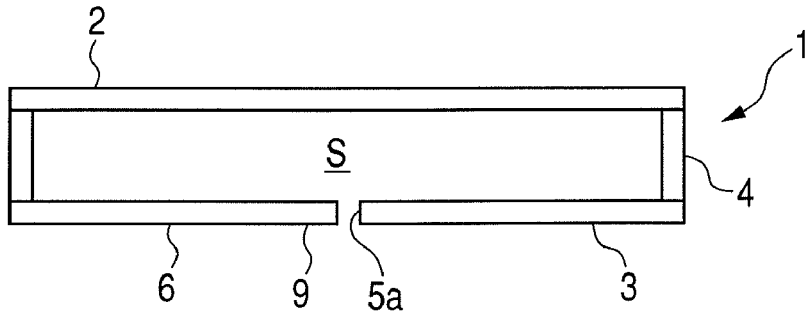
FIGS. 2A, 2B, 2C, 2D and 2E are schematic step views indicating a sealing process of the second embodiment.

As indicated in FIG. 2A, the inside of the container 1 is exhausted via the through-hole 5*a* provided on a surface of the container 1. This step is same as that in the first embodiment.

(Step S52)

Figure 2B:
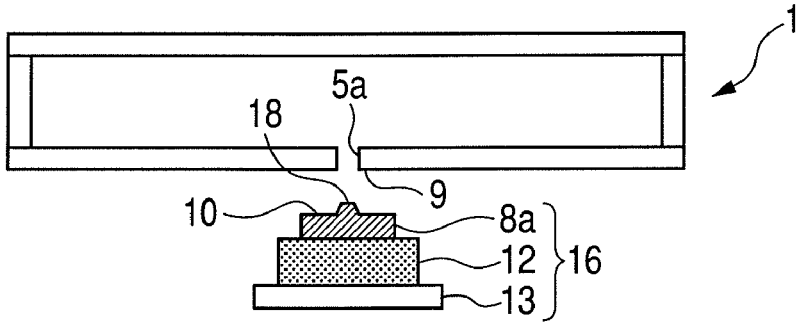

As indicated in FIG. 2B, a laminated body 16, where a plate member 8*a* and the cover member 13 were laminated with the sealant 12 interposed between the plate member 8*a* and the cover member 13, is prepared. The cover member 13, which is the same one as that in the first embodiment, can be used. As the plate member, the plate member 8 in the first embodiment can be used. However, in the present embodiment, the plate member 8*a*, which has a cylindrical or semispherical projection 18, capable of being inserted inside a through-hole 5*a* is used. As will be described later, when the plate member 8*a* is made to be contacted with the outer surface 6 of the container 1, the projection 18 is inserted inside the through-hole 5*a*. That is, the projection 18 functions as a guide when the plate member 8*a* is made to be contacted with the through-hole 5*a*. Therefore, it is desirable that the projection 18 has such a size (diameter) to be naturally set in the through-hole 5*a*. The sealant 12, which is the same one as that in the first embodiment, can be used. At a previous step before forming the laminated body 16, at least one of the plate member 8*a* and the cover member 13 may be heated within a range that the sealant 12 is not melted.

(Step S53)

Figure 2C:
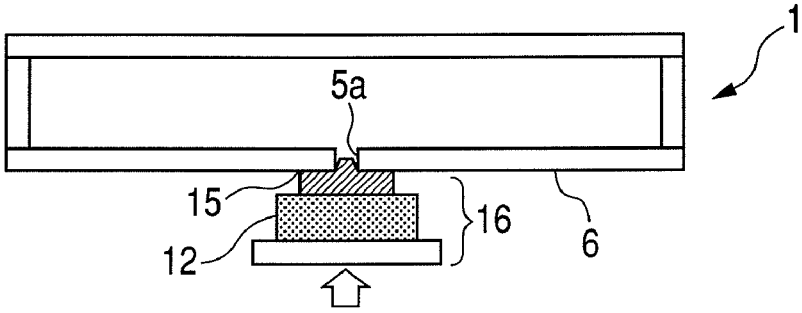

As indicated in FIG. 2C, the laminated body 16 is arranged on the outer surface 6 of the container 1 of which the inside was exhausted such that the plate member 8*a* contacts with the outer surface 6 along the peripheral area 9 (refer to FIG. 2A) of the through-hole 5*a*, which is closed by the plate member 8*a*. This operation is performed with a state that the through-hole 5*a* is opened in the vertical downward direction as mentioned above. Since the projection 18 is inserted inside the through-hole 5*a*, the positioning is easily performed. At this time, according to the characteristic of the sealant 12, the sealant 12 may be heated at a level that the sealant 12 is not melted.

(Step S54)

Figure 2D:
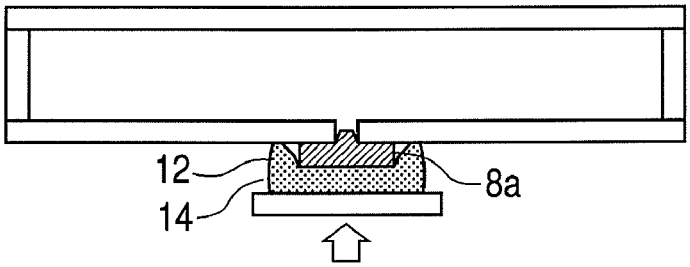
Figure 2E:
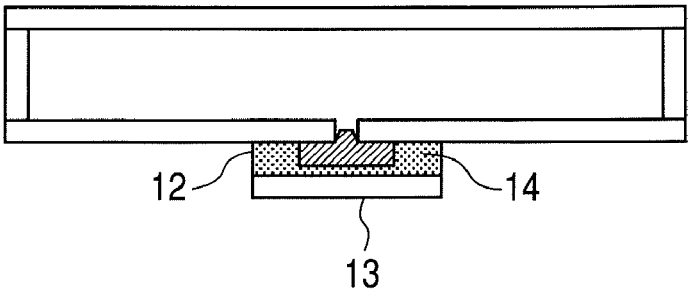

As indicated in FIG. 2D, the sealant 12 is pressed in the vertical upward direction (direction indicated by an outline arrow) by the cover member 13. A means of applying the load can be properly selected similar to a case in the first embodiment. While maintaining this condition, the sealant 12 is heated to the temperature of melting the sealant 12. The melted sealant 12 is deformed so as to fill up the space 14 between the cover member 13 and the outer surface 6 of the container 1 along the outer circumference portion 15 of the contact surface 10. Specifically, when the sealant 12 is pressed by the cover member 13, a part of the sealant 12 shifts to the lateral direction of the plate member 8*a* while deforming as indicated in FIG. 2D. And, another part of the sealant 12 also extends to the lateral direction being trailed by the cover member 13. When the sealant 12 is further pressed by the cover member 13, the sealant 12 completely fills up the space 14 as indicated in FIG. 2E and a width of the sealant 12 is extended to such a width nearly equal to that of the cover member 13. Thereafter, the sealant 12 is heated to be hardened. In this manner, in the present embodiment, the laminated body is pressed such that the plate member closes up the through-hole, and the cover member and the outer surface of the container are bonded via the sealant and the container 1 is sealed. And, a fact that a seal-bonding process includes a process of hardening the sealant after deforming the sealant while pressing the plate member by the cover member is also similar to a case in the first embodiment.

In the present embodiment, the through hole can be sealed with a state that the through hole is opened in the vertical downward direction and the same effect as that in the first embodiment can be exhibited. That is, the melted sealant 12 hardly flows into the through-hole 5*a*, and in the flat panel image displaying apparatus, a discharge phenomenon caused by the sealant 12, which was flown in, can be easily prevented. The negative influence to an electron emitter or the like due to the gas hardly occurs. And, the sealing performance itself is improved and the defective airtightness can be easily prevented. Even if the pressing load is large in some degree, deformation of the sealant 12 is prevented to be fixed to such a level less than the thickness of the plate member 8*a*, and this fact leads to an improvement of reliability of the airtightness. Furthermore, in the present embodiment, a process of sequentially providing the plate member 8*a*, the sealant 12 and the cover member 13 is not required, additionally, since a process of forming the laminated body 16 can be individually performed, an effect capable of rationalizing the sealing process is also obtained.

In the present embodiment, although an example that the laminated body composed of the plate member, the sealant and the cover member is made to be contacted with the airtight container from the downward side has been described, a contacting method is not limited to this method and the laminated body may be contacted from the upward side. As described in the first embodiment, also in the present embodiment, when the sealant 12 is deformed, the sealant 12 may be pressed by the cover member 13 while rotating the cover member 13 around an axis by treating the axis parallel to the direction of pressing the sealant 12 as a center of rotation. In addition, at least one of the plate member and the cover member may be heated within a range that the sealant is not melted before a process of deforming the sealant.

Hereinafter, the present invention will be described in detail as specific embodiments.

Embodiment 1

Figure 3:
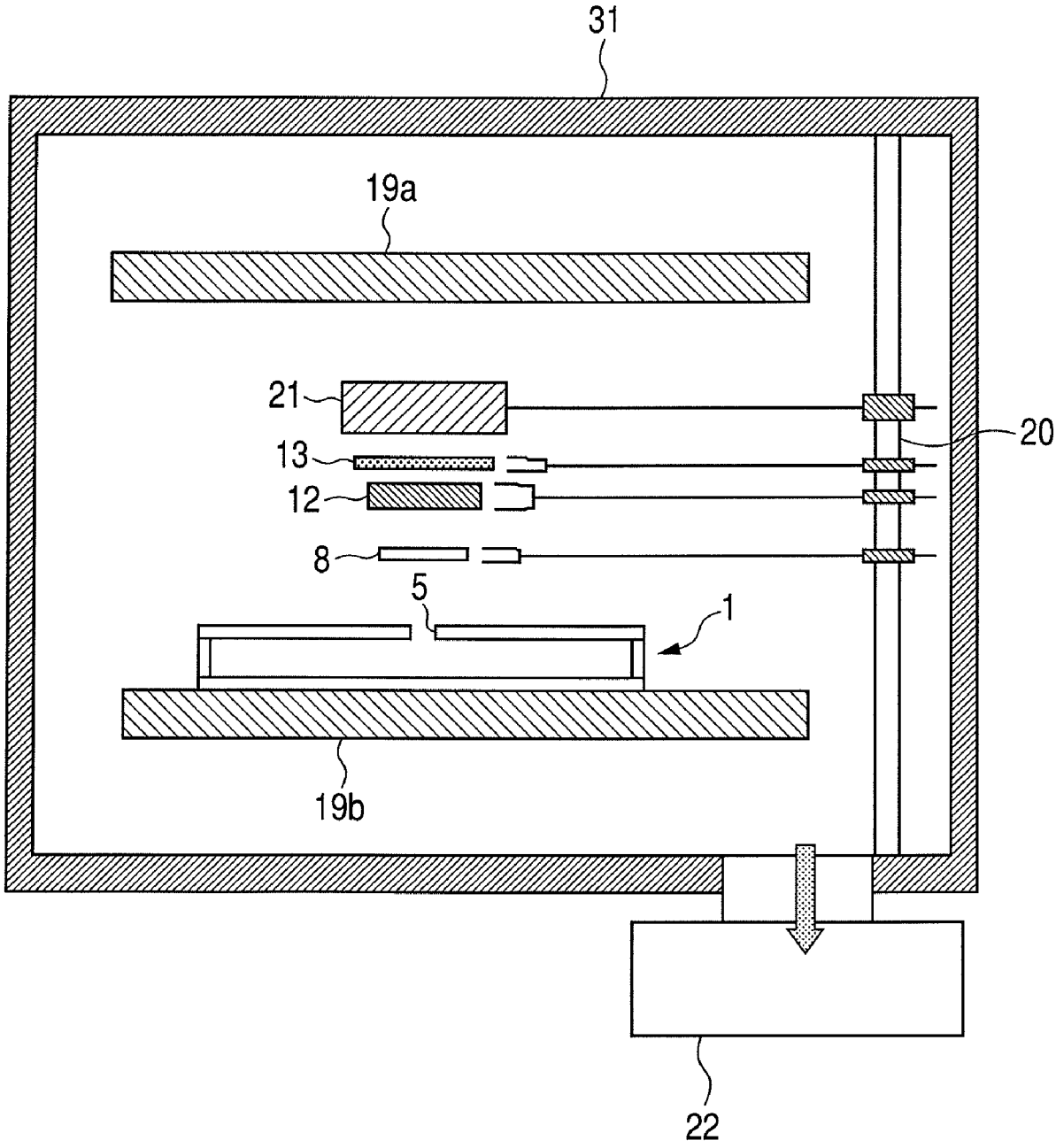
FIG. 3 is a view indicating the first embodiment.

The present embodiment is an example of fabricating an airtight container by using the first embodiment. The present embodiment will be described with reference to FIG. 3.

In the present embodiment, a container 1 is stored in a vacuum-exhaust chamber 31, which was exhausted to be vacuumized by using an exhaust unit 22 having a turbomolecular pump and a dry scroll pump. Heaters 19*a* and 19*b* used for the heating are provided in the vacuum-exhaust chamber 31 as heating units. The container 1 has a through-hole 5, of which diameter is 3 mm, on its upper surface.

As the plate member 8, a soda lime glass, of which diameter is 5 mm and thickness is 300 μm, was prepared. As the sealant 12, a glass frit, which was molded into such the size of which diameter is 7 mm and thickness is 400 μm by the pre-baking, and from which a paste component was eliminated, was prepared. As the cover member 13, a soda lime glass, of which diameter is 8 mm and thickness is 800 μm, was prepared. As a load applying weight 21, a weight of 150 g made from SUS340 stainless steel was prepared. These respective members are mounted on the rotating/vertical moving mechanism 20 which can individually perform the vertical movement and the rotation movement every the member and arranged in the vacuum-exhaust chamber 31.

Process (a)

The exhaust unit 22 is made to be operated to exhaust the inside of the vacuum-exhaust chamber 31, and the vacuum degree of the inside of the container 1 was decreased to a level equal to or less than $1\times10^{-3}$ Pa via the through-hole 5. The heaters 19*a* and 19*b* are made to be operated in response to an exhausting process, and the respective members arranged inside the vacuum-exhaust chamber 31 are heated to the temperature of 350° C. which is less than the softening temperature of the glass frit serving as the sealant 12.

Process (b)

The plate member 8 is arranged on a position just above the through-hole 5 by the rotating/vertical moving mechanism 20.

Process (c)

The sealant 12 is arranged on a position just above the plate member 8 by the rotating/vertical moving mechanism 20.

Process (d)

The cover member 13 is arranged on a position just above the sealant 12 by the rotating/vertical moving mechanism 20. Thereafter, the load applying weight 21 is rotationally moved to a position just above the cover member 13 by the rotating/vertical moving mechanism 20, and the load applying weight 21 is slowly descended at a speed of 1 mm/min by the rotating/vertical moving mechanism 20 such that the load is not rapidly added and then the load applying weight 21 is mounted on the cover member 13.

Process (e)

The heating process was executed to reach the softening temperature of the glass frit.

Thereafter, the load applying weight 21 is cooled to the room temperature while mounting the weight 21 on the cover member 13 and then the inside of the vacuum-exhaust chamber 31 is purged, and the fabricated container 1 is taken out from the vacuum-exhaust chamber 31.

As processed above, the through-hole was sealed by the sealant, and a vacuum airtight container of which the inside was exhausted to be vacuumized was fabricated. A glass frit of which thickness is 305 μm was formed leaving no space between the cover member 13 and the outer surface 6 of the container 1. In the present embodiment, the plate member 8 is continuously pressed to a peripheral area of the through-hole 5 also during a period that the glass frit serving as the sealant is melted and squashed in the process (e) by a fact that the load applying weight 21 was mounted on the cover member 13 in the process (d). Consequently, a fact that the sealant 12 flowed into the through-hole 5 was not confirmed. In addition, since two places, that is, a place between the plate member 8 and the peripheral area of the through-hole 5 and a place between the cover member 13 and the peripheral area of the through-hole 5 are sealed, a vacuum airtight container having the sufficient airtightness can be obtained.

Embodiment 2

The present embodiment is an example of fabricating an airtight container by using the second embodiment indicated in FIG. 2. The present embodiment will be described with reference to FIG. 4.

In the present embodiment, the container 1 is stored in the vacuum-exhaust chamber 31, which was exhausted to be vacuumized by using the exhaust unit 22 having the turbomolecular pump and the dry scroll pump. The heaters 19*a* and 19*b* used for the heating are provided in the vacuum-exhaust chamber 31 as heating units. The container 1 has two substrates which are oppositely arranged each other, and surface-conduction electron emitters (not illustrated) are formed on an inner surface of the one substrate and an anode electrode and a light emission member (not illustrated) are formed on an inner surface of the other substrate. The container 1 has a through-hole 5*a*, of which diameter is 4 mm, on its lower surface.

As the cover member 13, a non-alkaline glass, of which diameter is 10 mm and thickness is 500 μm, was prepared. The sealant 12 which was composed of In (indium) and molded into such the size, of which diameter is 8 mm and thickness is 400 μm, was provided on that cover member 13. The plate member 8*a* composed of the non-alkaline glass, of which diameter is 5 mm and thickness is 300 μm, having the projection 18, of which diameter is 1 mm and height is 2 mm, on a central position of the plate is mounted on that sealant 12, and the laminated body 16 was prepared. The rotating/vertical moving mechanism 23 has a stage 24, which can apply the press force to be operated in the vertical upward direction by a spring member 25 of which a spring constant is about 1N/mm (100 gf/mm). The laminated body 16 set on the stage 24 was arranged in the vacuum-exhaust chamber 31.

Process (a)

Initially, the laminated body 16 was made to be escaped to a position not to be heated by the heaters 19*a* and 19*b* by the rotating/vertical moving mechanism 23. Next, the exhaust unit 22 is made to be operated to exhaust the inside of the vacuum-exhaust chamber 31, and the vacuum degree of the inside of the container 1 was decreased to a level equal to or less than $1\times10^{-4}$ Pa via the through-hole 5*a*. The heaters 19*a* and 19*b* are made to be operated in response to an exhausting process, and the container 1 was heated with the temperature of 350° C. for an hour by the heaters 19*a* and 19*b* in order to exhaust the adsorption gas exists in the container 1. After that, the heaters 19*a* and 19*b* and the container 1 were naturally cooled to reach the temperature of 100° C.

Process (b)

The laminated body 16 was moved to a position just below the through-hole 5*a* by the rotating/vertical moving mechanism 23. Subsequently, the reheating process is performed by the heaters 19*a* and 19*b* while continuously exhausting the inside of the chamber 31, and respective members of the container 1, the stage 24 including the spring member 25 and the laminated body 16 are heated to the temperature of 100° C. equal to or less than the melting temperature of the In so as to become the same temperature as that of the container 1.

Process (c)

The laminated body 16 held by the stage 24 was slowly moved upward by using the rotating/vertical moving mechanism 23 until when the plate member 8*a* contacts with a peripheral area of the through-hole 5*a* with a state that the projection 18 of the plate member 8*a* is inserted in the through-hole 5*a*. Subsequently, the rotating/vertical moving mechanism 23 was moved upward 5 mm with a speed of 1 mm/sec such that the plate member 8*a* is pressed by the spring member 25.

Process (d)

The temperature of the container 1 and the respective members was raised to 160° C., which is equal to or larger than the melting temperature of the In (indium), at a speed rate of 3° C./min by the heaters 19*a* and 19*b*. Also when the In is melted, since the respective members are continuously pressed toward the through-hole 5*a* by the spring member 25, the sealant 12 is deformed in response to the melting of the In, and the through-hole 5*a* was sealed.

After that, the temperature is cooled down to the room temperature while pressing the laminated body 16 by the spring member 25 and then the inside of the vacuum-exhaust chamber 31 is purged, and the fabricated container 1 was taken out from the vacuum-exhaust chamber 31.

As processed above, in a formed airtight container, the In of which thickness is 300 μm was formed leaving no space between the cover member 13 and the outer surface 6 of the container 1. Since the pressing by the spring member was continuously performed in the processes (c) and (d), the plate member 8*a* is continuously pressed to the peripheral area of the through-hole 5*a* also during a period that the In serving as the sealant 12 is melted and deformed in the process (d), and it was able to prevent that the sealant 12 flows into the through-hole 5*a*. In addition, since two places, that is, a place between the plate member 8*a* and the peripheral area of the through-hole 5*a* and a place between the cover member 13 and the peripheral area of the through-hole 5*a* are sealed, the vacuum airtight container having the sufficient airtightness can be obtained.

In this manner, an image formation apparatus, of which the inside was exhausted to be vacuumized, having surface-conduction electron emitters in its inside can be obtained. Although the voltage of 15 kV was applied between an anode electrode and a cathode electrode of this image formation apparatus for 24 hours, the electric discharge is not generated in an area of the image formation apparatus and a peripheral area of the above area, and it was confirmed that the electron accelerating voltage can be stably applied.

Embodiment 3

The present embodiment is an example of fabricating an airtight container by using the second embodiment. The present embodiment will be described with reference to FIG. 2, FIGS. 5A to 5E and FIG. 6.

In the present embodiment, it is constituted that the container 1 has a through-hole, of which diameter is 2 mm, on its lower surface and has a support member (spacer) 26 in its inside so as not to be destroyed even if the load is locally applied to a circumference of an aperture from the outside of a container. A flange 30, which serves as an exhaust pipe of which bore diameter is larger than that of the through-hole, has the rotating/vertical moving mechanism 23 according to a straight line manipulator, the spring member 25 and an internal heater 19*c* connected with the spring member in its inside. It is constituted that the load can be applied in accordance with the pressing degree by pressing the heater to the container side by the rotating/vertical moving mechanism. In addition, it is constituted that the exhaust unit 22 having the turbo-molecular pump and the dry scroll pump is connected with the flange 30 of which the inside can be exhausted to be vacuumized.

The plate member 8*a*, which has a projection of which diameter is 1.9 mm and height is 500 μm on a disc-like plate of which diameter is 5 mm and height is 500 μm, is made from the PD-200 produced by the Asahi Glass Co., Ltd. The sealant 12 was made from the alloy composed of In and Ag molded into such the size of which diameter is 4 mm and thickness is 1.5 mm. As a cover member 13*a*, a tray-like member having a concave portion of which diameter is 4 mm and depth is 1 mm was made by using the PD-200. And, the plate member 8*a*, the sealant 12 and the cover member 13*a* are laminated each other in this order to form a laminated body, which was arranged inside the exhaust pipe.

Process (a)

The cover member 13*a*, the sealant 12 and the plate member 8*a* are sequentially laminated and arranged on the internal heater 19*c* arranged inside the flange 30 similar to a case in FIG. 2 with a state that centers of respective diameters of the members are coincided with each other.

Process (b)

An O-ring 29 consisted of Material Viton® (registered trademark) was arranged on an aperture portion of the flange 30.

Process (C)

The vacuum exhaust is started by the exhaust unit 22 while pressing the O-ring 29 by the container 1 and the flange 30 at a position, where the O-ring 29 contacts with a circumference of the through-hole 5*a* of the container 1 and centers of diameters of the respective members in the process (a) coincides with a center of the through-hole 5*a*, and the inside of the container 1 is exhausted to be vacuumized.

Process (d)

After the internal heater 19*c* inside the flange 30 was heated to the temperature of 150° C. to be held, the temperature was raised to 170° C. at a speed rate of 1° C./min. Then, the laminated body composed of the plate member 8*a*, the sealant 12 and the cover member 13*a* is moved along the exhaust pipe by elevating the rotating/vertical moving mechanism inside the flange at a speed of 1 mm/min and the laminated body was pressed to the outer surface of the container while arranging the laminated body so as to close up through-hole.

Process (e)

After that, the internal heater 19*c* was naturally cooled to the room temperature while keeping a state of applying the press force generated in the process (d). Then, after the sealant 12 was hardened, the exhausting process by the exhaust unit 22 is stopped, and after purging the inside of the flange 30 by the air, the O-ring 29 was separated from the container 1.

As processed above, the container is sealed by bonding the outer surface of the container with the cover member via the sealant and a vacuum airtight container of which the inside was exhausted to be vacuumized was fabricated. In the process (d), also during a period that the sealant 12 is melted and deformed, since the plate member 8*a* is continuously pressed to a peripheral area of the through-hole 5*a*, it was able to prevent that the sealant 12 flows into the through-hole 5*a*. In addition, since two places, that is, a place between the plate member 8*a* and the peripheral area of the through-hole 5*a* and a place between the cover member 13*a* and the peripheral area of the through-hole 5*a* are sealed, a vacuum airtight container having the sufficient airtightness can be obtained. Also, in the present embodiment, the sealant is formed in the inside (concave portion) of the cover member 13*a* leaving no space by equalizing the inner volume of the inside of the tray-like member (inner volume of a concave portion) of the cover member 13*a* with the sum of the volume of the plate member 8*a* and the volume of the sealant, and the appearance of not flowing the sealant to the outside of the cover member 13*a* was obtained. As compared with a case that the whole container 1 was arranged in the vacuum chamber, when plural vacuum airtight containers were sequentially fabricated, since the container 1 is connected at a portion of the O-ring 29 and the inside of the flange and the inside of the container have only to be exhausted, the inner volume which has to be exhausted to be vacuumized results in a little volume. Consequently, the time required for the exhaust will be resulted in a short time, and the total fabrication time can be shortened.

Embodiment 4

The present embodiment is an example of fabricating an airtight container of an image displaying apparatus by partially modifying the second embodiment. The present embodiment will be described with reference to FIGS. 2A to 2E, FIG. 4 and FIG. 7.

Figure 4:
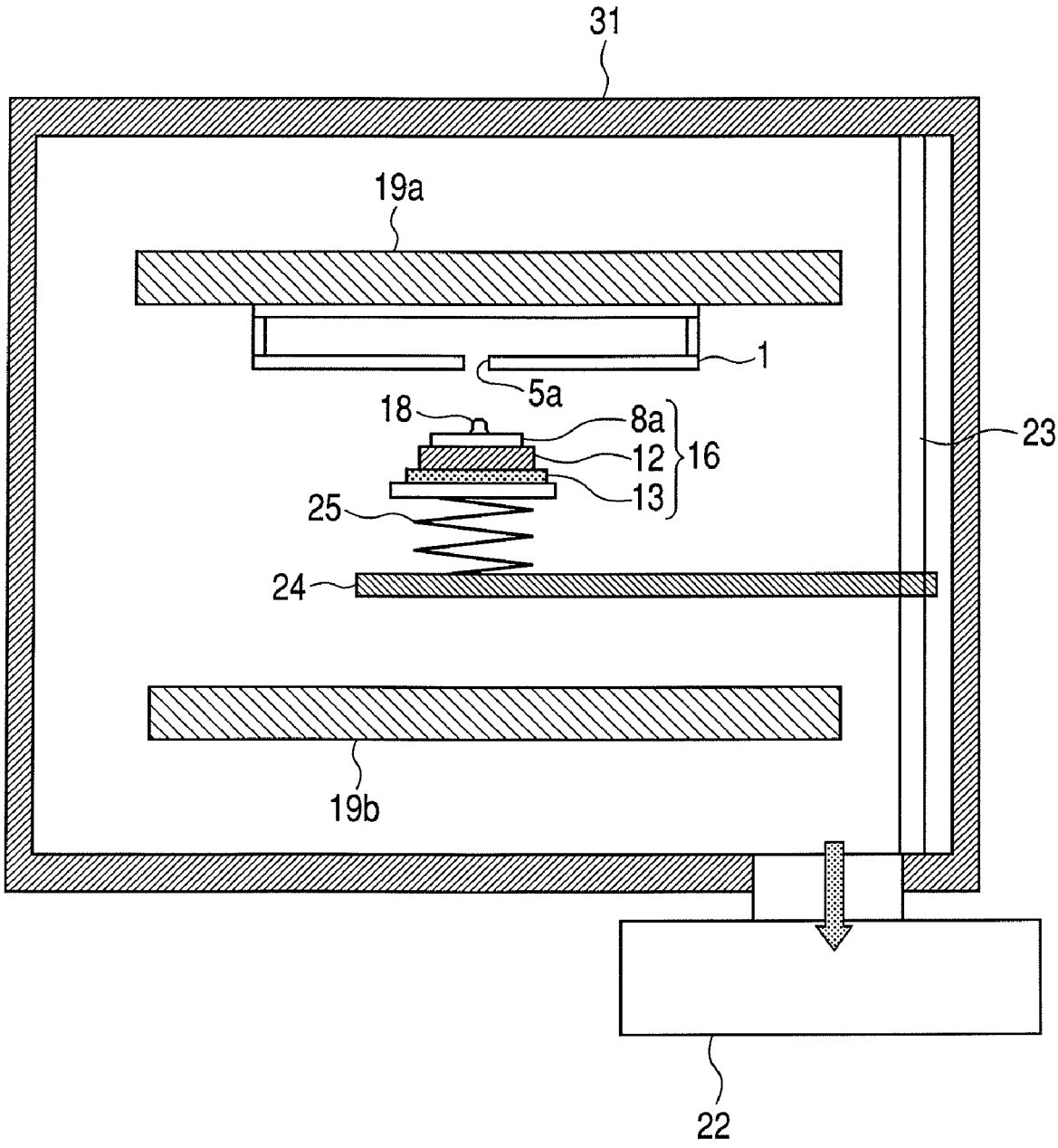
FIG. 4 is a view indicating the second embodiment.
Figure 5A:
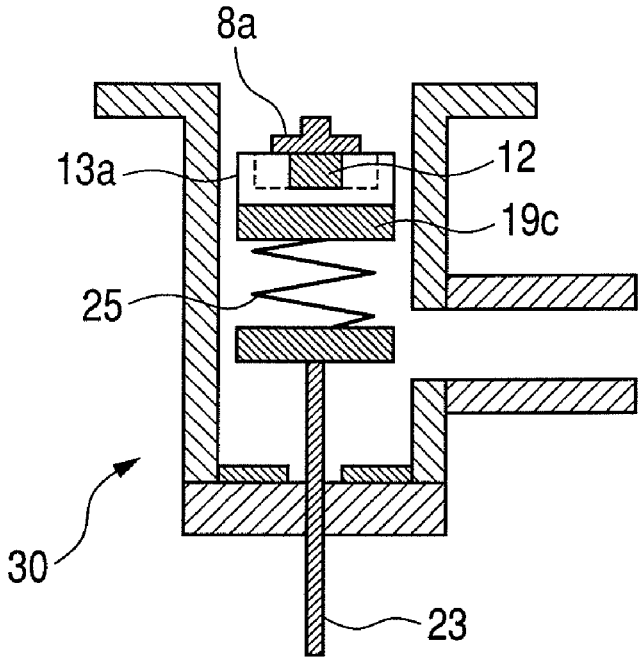
FIGS. 5A, 5B, 5C, 5D and 5E are views indicating the third embodiment.
Figure 5B:
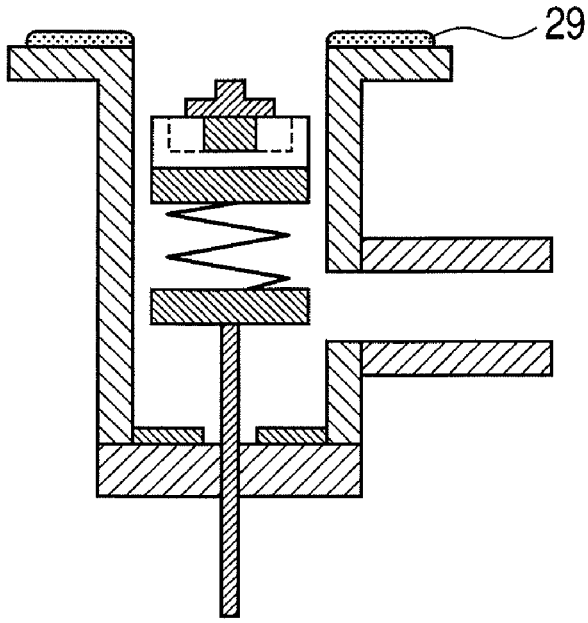
Figure 5C:
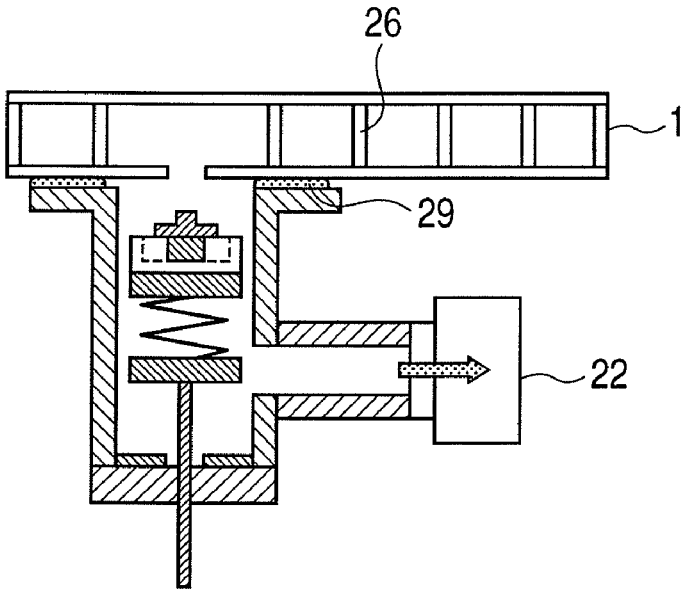
Figure 5D:
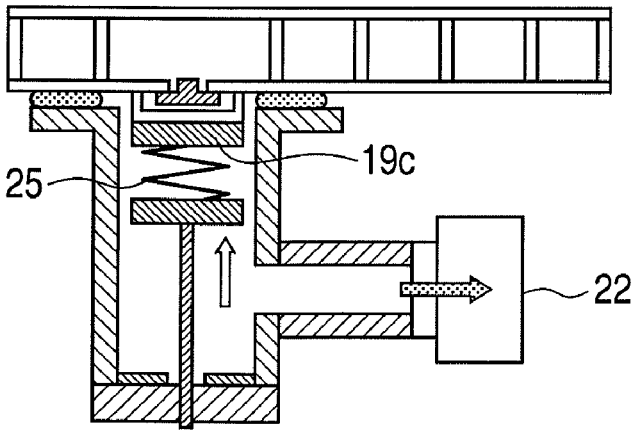
Figure 5E:
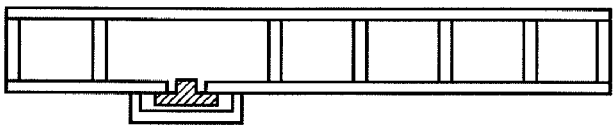
Figure 6:
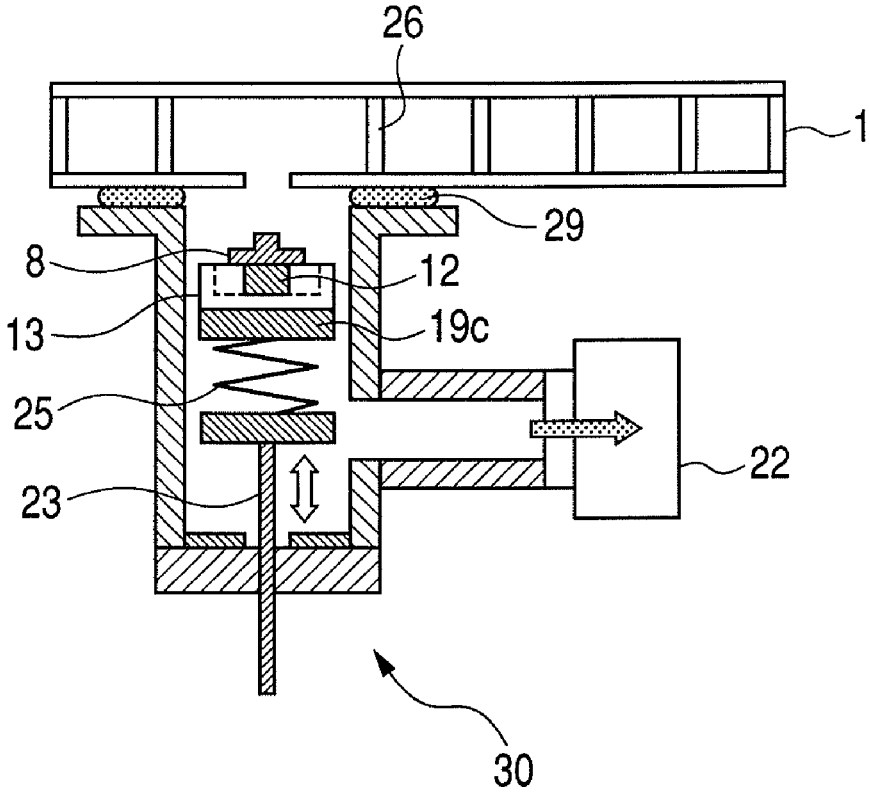
FIG. 6 is a view indicating the third embodiment.
Figure 7:
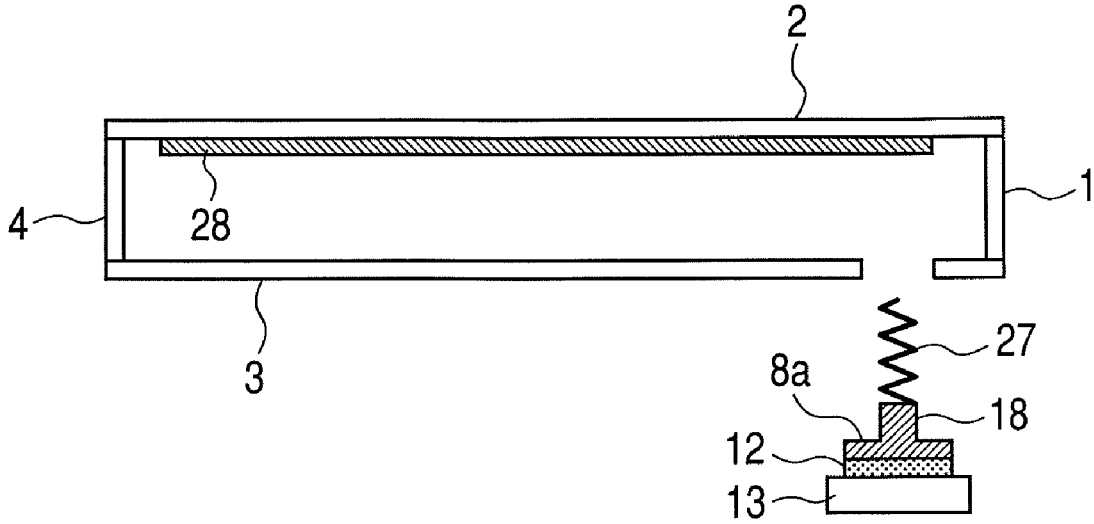
FIG. 7 is a view indicating the fourth embodiment.

In the present embodiment, as indicated in FIG. 7, it is characterized in that an anode electrode 28 is provided inside the container 1, which becomes to serve as an envelope, and a spring terminal 27, which serves as a terminal unit consisted of a conductive material, is provided on the plate member 8*a* having a projection. Note that the constitution is similar to that in the embodiment 2 excepting a point that the spring terminal 27 is provided and the material of the plate member is different from the material of the cover member. As indicated in FIG. 4, the container 1 is stored in the vacuum-exhaust chamber 31, which was exhausted to be vacuumized by using the exhaust unit 22 having the turbo-molecular pump and the dry scroll pump. The heaters 19*a* and 19*b* are included in the vacuum-exhaust chamber 31 as the heating units. And, as indicated in FIGS. 2A to 2E and FIG. 7, the container 1 has the face plate 2 and the rear plate 3 which are oppositely arranged each other. And, surface-conduction electron emitters (not illustrated) are formed on an inner surface of the rear plate 3 having the through-hole, and the anode electrode 28 and the light emission member (not illustrated) are formed on an inner surface of the face plate 2. And, the envelope (container 1) is formed such that the surface-conduction emitters, the anode electrode and the light emission member are arranged in the envelope. The container 1 has the through-hole 5*a*, of which diameter is 4 mm, on its lower surface. The distance from the outside of a hole to the anode electrode is 3.4 mm.

As in FIGS. 2A to 2E and FIG. 7, a Fe—Ni alloy, of which diameter is 10 mm and thickness is 500 μm, was prepared as the cover member 13, on which the sealant 12 consisted of the In molded into such the size, of which diameter is 8 mm and thickness is 400 μm, was provided. On the sealant 12, the plate member 8*a*, of which diameter is 5 mm and thickness is 300 μm, consisted of the Fe—Ni alloy having the projection 18, of which diameter is 1 mm and height is 1 mm and an upper portion is welded with the spring terminal 27 consisted of the conductive material, in its central position is mounted, and the laminated body 16 was prepared. The length of the spring terminal is 4 mm. The rotating/vertical moving mechanism 23 has the stage 24, which can apply the press force to be operated in the vertical upward direction by the spring member 25 of which a spring constant is about 1N/mm (100 gf/mm). The laminated body 16 set on the stage 24 was arranged in the vacuum-exhaust chamber 31.

Process (a)

Initially, the laminated body 16 was made to be arranged to a position not to be heated by the heaters 19*a* and 19*b* by the rotating/vertical moving mechanism 23. Next, the exhaust unit 22 is made to be operated to exhaust the inside of the vacuum-exhaust chamber 31, and the vacuum degree of the inside of the container 1 was decreased to a level equal to or less than $1\times10^{-4}$ Pa via the through-hole 5*a*. The heaters 19*a* and 19*b* are made to be operated in response to an exhausting process, and the container 1 was heated with the temperature of 350° C. for an hour by the heaters 19*a* and 19*b* in order to exhaust the adsorption gas exists in the container 1. After that, the heaters 19*a* and 19*b* and the container 1 were naturally cooled to reach the temperature of 100° C.

Process (b)

The laminated body 16 was moved to a position just below the through-hole 5*a* by the rotating/vertical moving mechanism 23. Subsequently, a reheating process is performed by the heaters 19*a* and 19*b* while continuously exhausting the inside of the chamber 31, and respective members of the container 1, the stage 24 including the spring member 25 and the laminated body 16 are heated to the temperature of 100° C. equal to or less than the melting temperature of the In so as to become the same temperature as that of the container 1.

Process (c)

The laminated body 16 held by the stage 24 was slowly moved upward by using the rotating/vertical moving mechanism 23 until when the plate member 8*a* contacts with a peripheral area of the through-hole 5*a* with a state that the projection 18 of the plate member 8*a* is inserted in the through-hole 5*a*. Subsequently, the rotating/vertical moving mechanism 23 was moved upward 5 mm with a speed of 1 mm/sec such that the plate member 8*a* is pressed by the spring member 25.

Process (d)

The temperature of the container 1 and the respective members was raised to 160° C., which is equal to or larger than the melting temperature of the In, at a speed rate of 3° C./min by the heaters 19*a* and 19*b*. Also when the In is melted, since the respective members are continuously pressed toward the through-hole 5*a* by the spring member 25, even if the sealant 12 is deformed in response to the melting of the In, the sealant does not flow into the through-hole 5*a*, and the container 1 was sealed. In this case, as mentioned above, since the sum of the length of the spring terminal 27 and the length of the projection 18 of the plate member is larger as compared with the distance from the outer surface of the rear plate to the anode electrode, the spring member 27 serving as a terminal unit is fixed with a state of contacting with the anode electrode 28 while keeping a state that the spring member was shortened 1.6 mm.

After that, the temperature is cooled down to the room temperature while pressing the laminated body 16 by the spring member 25 and then the inside of the vacuum-exhaust chamber 31 is purged, and the fabricated container 1 was taken out from the vacuum-exhaust chamber 31.

As processed above, in a formed airtight container, the In of which thickness is 300 μm was formed leaving no space between the cover member 13 and the outer surface 6 of the container 1. Since the pressing by the spring member was continuously performed in the processes (c) and (d), the plate member 8*a* is continuously pressed to the peripheral area of the through-hole 5*a* also during a period that the In serving as the sealant 12 is melted and deformed in the process (d), and it was able to prevent that the sealant 12 flows into the through-hole 5*a*. In addition, since two places, that is, a place between the plate member 8*a* and the peripheral area of the through-hole 5*a* and a place between the cover member 13 and the peripheral area of the through-hole 5*a* are sealed, the vacuum airtight container having the sufficient airtightness can be obtained.

In this manner, an image displaying apparatus, of which the inside was exhausted to be vacuumized, having surface-conduction electron emitters in its inside can be obtained. Note that the spring terminal 27 consisted of a conductive material is kept with a state of contacting with the anode electrode 28 arranged inside the image displaying apparatus. Since the plate member 8*a* welded with the spring terminal 27 is the Fe—Ni alloy, the sealant 12 is the In and the cover member 13 is also the Fe—Ni alloy, the cover member 13 and the anode electrode 28 are electrically conductive. In this manner, in the present embodiment, the container was able to be sealed and the conductive electrode to the inside of the vacuum container was able to be fabricated at the same time in fabricating the vacuum airtight container. In the present embodiment, an envelope of the image displaying apparatus was fabricated by using the laminated member obtained by laminating the plate member, the sealant and the cover member. However, a fabricating method is not limited to this method but can be applied to the method described in the Embodiment 1, and a similar effect can be obtained also in that case.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-194615, filed Jul. 26, 2007, and Japanese Patent Application No. 2008-165697, filed Jun. 25, 2008 which are hereby incorporated by reference herein in their entirety.

What is claimed is:

1. A manufacturing method of an image displaying apparatus, comprising an airtight container having a vacuum interior, comprising the steps of:

exhausting an inside of a container via a through-hole provided in the container;

arranging a plate member on an outer surface of the container, the inside of which was exhausted, so as to close the through-hole;

sealing the container by arranging a cover member to cover the plate member and by bonding the arranged cover member and the outer surface of the container to each other via a sealant positioned between the cover member and the outer surface of the container, wherein the sealing includes hardening the sealant after deforming the sealant by pressing the plate member;

providing an anode electrode in the airtight container, wherein the plate member has a terminal portion including a conductive material; and performing the sealing in a state that the terminal portion is in contact with the anode electrode.

* * * * *